US008057862B2

(12) United States Patent
Chen et al.

(10) Patent No.: US 8,057,862 B2
(45) Date of Patent: Nov. 15, 2011

(54) METHOD FOR JETTING COLOR INK

(75) Inventors: Wen-Lung Chen, Hsin-Chu (TW); Shu-Chin Lee, Hsin-Chu (TW); Wei-Ya Wang, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 345 days.

(21) Appl. No.: 12/423,919

(22) Filed: Apr. 15, 2009

(65) Prior Publication Data

US 2009/0195574 A1 Aug. 6, 2009

(30) Foreign Application Priority Data

May 12, 2008 (TW) ..... 97117456 A
May 15, 2008 (TW) ..... 97117860 A

(51) Int. Cl.
*B05C 11/10* (2006.01)

(52) U.S. Cl. ..... 427/427.2; 347/9; 347/12; 347/19

(58) Field of Classification Search ..... 347/9, 19, 347/12; 274/9, 10, 427.2; 427/9, 10, 427.2
See application file for complete search history.

(56) References Cited

U.S. PATENT DOCUMENTS

| | | | | |
|---|---|---|---|---|
| 5,969,729 | A * | 10/1999 | Erickson et al. | 347/9 |
| 7,111,755 | B2 | 9/2006 | Koyama et al. | |
| 2002/0018106 | A1 * | 2/2002 | Dunand | 347/74 |
| 2004/0234678 | A1 | 11/2004 | Hirai et al. | |
| 2007/0042113 | A1 | 2/2007 | Ji et al. | |
| 2007/0182775 | A1 | 8/2007 | Kurita et al. | |

FOREIGN PATENT DOCUMENTS

| | | |
|---|---|---|
| CN | 1480327 | 3/2004 |
| CN | 101025454 | 8/2007 |
| TW | I232708 | 5/2005 |
| TW | 200736059 | 10/2007 |
| TW | 200817194 | 4/2008 |

OTHER PUBLICATIONS

English language translation of abstract of TW I232708 (published May 11, 2005).
English language translation of abstract of TW 200736059 (published Oct. 1, 2007).
English language translation of abstract of TW 200817194 (published Apr. 16, 2008).
English language translation of abstract of CN 101025454.
English language translation of abstract of CN 1480327 (published Mar. 10, 2004).

* cited by examiner

*Primary Examiner* — George Koch
(74) *Attorney, Agent, or Firm* — Thomas, Kayden, Horstemeyer & Risley, LLP

(57) ABSTRACT

A method for jetting color ink includes determining an initial voltage value of a nozzle, wherein the initial voltage value corresponds to a predetermined jetting volume of the nozzle; determining a maximum adjusting voltage value of the nozzle, wherein the maximum adjusting voltage value may correspond to an allowable error value of the predetermined jetting volume; combining the initial voltage value with an adjusting voltage value to obtain a jetting voltage, wherein the adjusting voltage value may be randomly selected between zero to the maximum adjusting voltage value; and jetting the color ink from the nozzle according to the jetting voltage onto a sub-pixel in a pixel.

3 Claims, 6 Drawing Sheets

METHOD FOR JETTING COLOR INK

RELATED APPLICATIONS

This application claims priorities to Taiwan Application Serial Number 97117456, filed May 12, 2008, and Taiwan Application Serial Number 97117860, filed May 15, 2008, which are herein incorporated by reference.

BACKGROUND

1. Field of Invention

The present invention relates to a fabricating method for a color filter, particularly, to a method for jetting color ink applied to color filters.

2. Description of Related Art

Liquid crystal displays have many advantages, such as high definition, small volume, lightweight, low voltage drive, low consumption of power, a broad range of applications, etc. Therefore, liquid crystal displays are already broadly used in consumer electronic devices or computer products, such as portable televisions, cellular phones, camcorders, laptop computers, desktop displays, projection televisions, etc., thereby becoming the main stream for displays.

Color filters are a substantially important component in liquid crystal displays. The basic structure of a color filter includes a glass substrate, a black matrix, a color layer, an over coat, and an ITO conductor film. Ink jetting, often used to manufacture color layers in the conventional art, uses a voltage parameter that mostly remains constant when nozzles jet ink. It is substantially difficult to remain the droplet sizes and landing points of droplets of the nozzles constant. If the constant droplets jetted from one nozzle is smaller, or the placement is not straight, differences appear in the constant color of sub-pixels, thereby affecting the quality of a color filter and the displaying quality of a panel.

Refer to FIG. 1 illustrating a schematic diagram of a defective color filter. The color filter 100 includes a plurality of pixels 110, and each pixel 110 also includes multiple sub-pixels 112, 114, 116. The sub-pixels 112, 114, 116 may respectively represent the three colors of red (R), green (G) and blue (B), and ink jetting may be used to fill the sub-pixels 112, 114, 116 with ink corresponding to color resists.

The droplets jetted by the nozzle 150*c* may be smaller than other's, thus the amount of color ink is smaller than other sub-pixels, thereby causing the same lighter footprint to appear in one constant column or multiple columns as shown as sub-pixel 112*c*, and affecting the quality of a color filter as well as the displaying quality of a panel.

SUMMARY

According to the situation disclosed in the prior art, the present invention provides a method for jetting color ink to prevent errors of a particular nozzle from causing the same lighter or darker footprints to appear in one constant column or multiple columns of a color filter, causing defects in color filters and in the displaying quality of panels.

In accordance with an aspect of the present invention, a method for jetting color ink includes: determining an initial voltage value of a nozzle, wherein the initial voltage value corresponds to a predetermined jetting volume of each nozzle; determining a maximum adjusting voltage value of the nozzle, wherein the maximum adjusting voltage value may correspond to an allowable error value of the predetermined jetting volume; combining the initial voltage value with an adjusting voltage value to obtain a jetting voltage, wherein the adjusting voltage value may be randomly selected between zero to the maximum adjusting voltage value; and jetting color ink from the nozzle according to the jetting voltage onto a sub-pixel in a pixel. The allowable error value may be plus or minus 2% of the predetermined jetting volume.

Another aspect of the present invention is a method for jetting color ink applied to a sub-pixel including determining a predetermined margin distance between a string of color ink droplets and a first border of the sub-pixel; determining a maximum variance value of the predetermined margin distance; randomly determining a variance value, wherein the variance value is selected between zero to the maximum variance value; combining the predetermined margin distance with the variance value to obtain a first margin distance; and jetting the color ink from a nozzle after the nozzle moving the first margin distance from the first border. Then, the nozzle stops jetting color ink after jetting color ink for a jetting distance to form a string of color ink droplets, and the distance between the string of color ink droplets and the second border of the sub-pixel is the second margin distance. The first margin distance and the second margin distance have a sum of twice the predetermined margin distance. The first margin distance may be the predetermined margin distance plus the variance value, while the second margin distance may be the predetermined margin distance minus the variance value, or the first margin distance may be the predetermined margin distance minus the variance value, while the second margin distance may be the predetermined margin distance plus the variance value.

Another aspect of the invention is a method for jetting color ink applied to a sub-pixel, including determining a predetermined margin distance between a string of color ink droplets and a first border of the sub-pixel; determining an initial time of jetting the string of color ink droplets; determining a maximum variance value; dividing the maximum variance value by a speed of movement of a nozzle to calculate a movement time of the maximum variance value; randomly determining a variance time according to the maximum variance value of the predetermined margin distance; combining the initial time with the variance time to obtain a jetting time; and beginning jetting of color ink from the nozzle after moving then first jetting time from the first border. The method further includes randomly selecting the variance time from zero to the movement time of the maximum variance value.

The method for jetting color ink of the present invention can spread out the differences in the size of color ink droplets and the droplet placement by randomly adjusting the jetting voltage of nozzles, by randomly adjusting the drop distance of a string of color ink droplets, or by randomly adjusting the jetting time for jetting the string of color ink droplets, thereby solving the problem of defects in color filters caused by differences in a particular nozzle.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DESCRIPTION OF THE EMBODIMENTS

The following clearly illustrates the spirit of the present invention using the accompanying drawings and detailed description. Any additional advantages and other novel features of the invention will be set forth in part in the description that follows and in part will become apparent to those skilled in the art upon examination of the following or may be learned with the practice of the invention. In addition, many modifications may be made to adapt a particular situation or material to the teachings of the invention without departing from the essential scope thereof.

The jetting voltages of the color ink nozzles in the prior art are mostly remain constant, and the jetting volume jetted by the nozzles is relevant to the jetting voltage. It is difficult to have the jetting droplets of the nozzles all remain equal in size, the differences between each nozzle become more apparent as the time of use increases. If droplets of a particular nozzle are smaller, it will result in the column of the string of droplets being thinner, thereby affecting the quality of the color filter. Therefore, the present invention provides a method for jetting color ink applied to color filters to reduce defects of color filters caused by uneven jetting of droplets.

Figure 1:
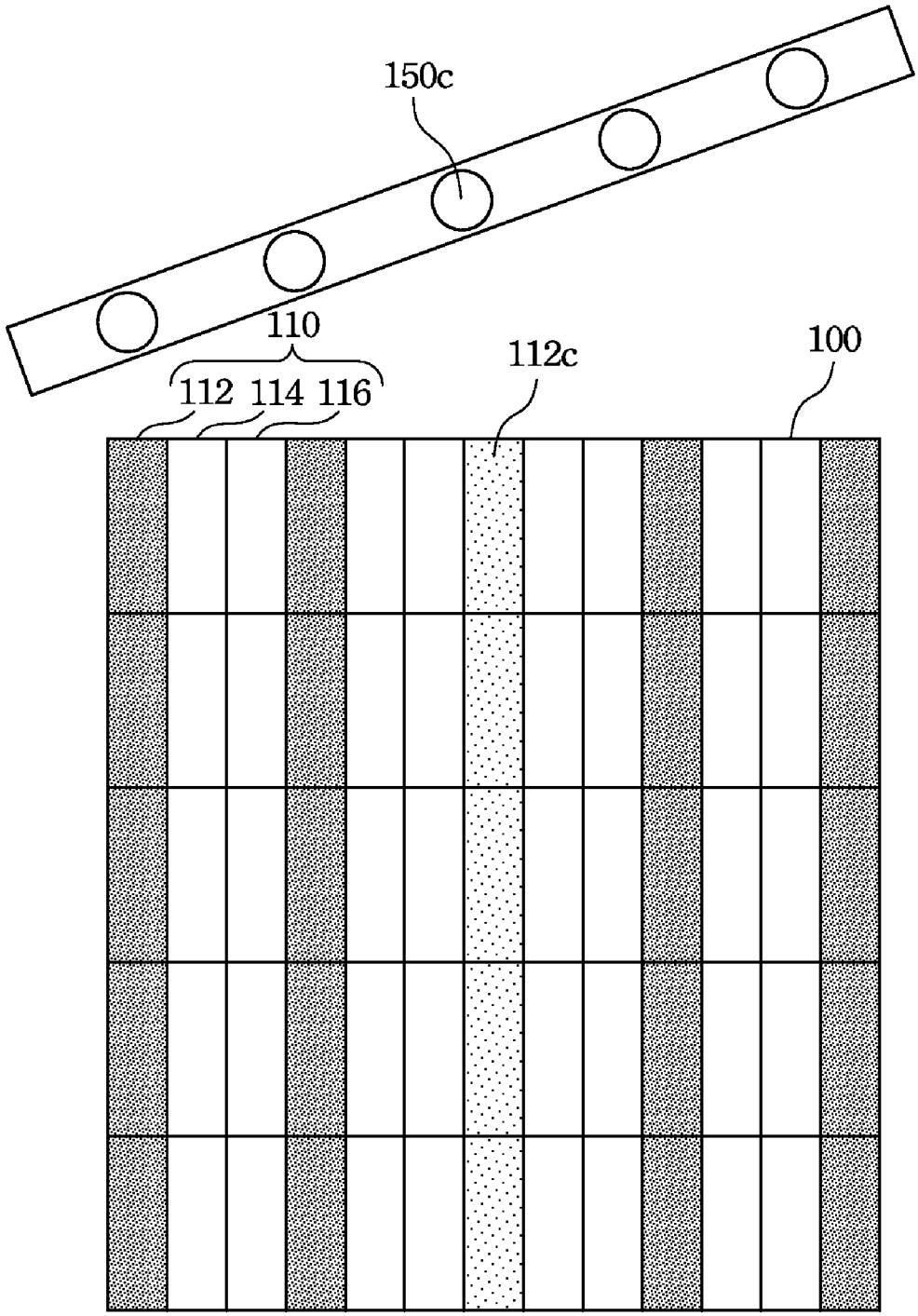
Fig. 1 (PRIOR ART)
FIG. 1 is a schematic diagram of an embodiment of a defective color filter in the prior art.
Figure 2:
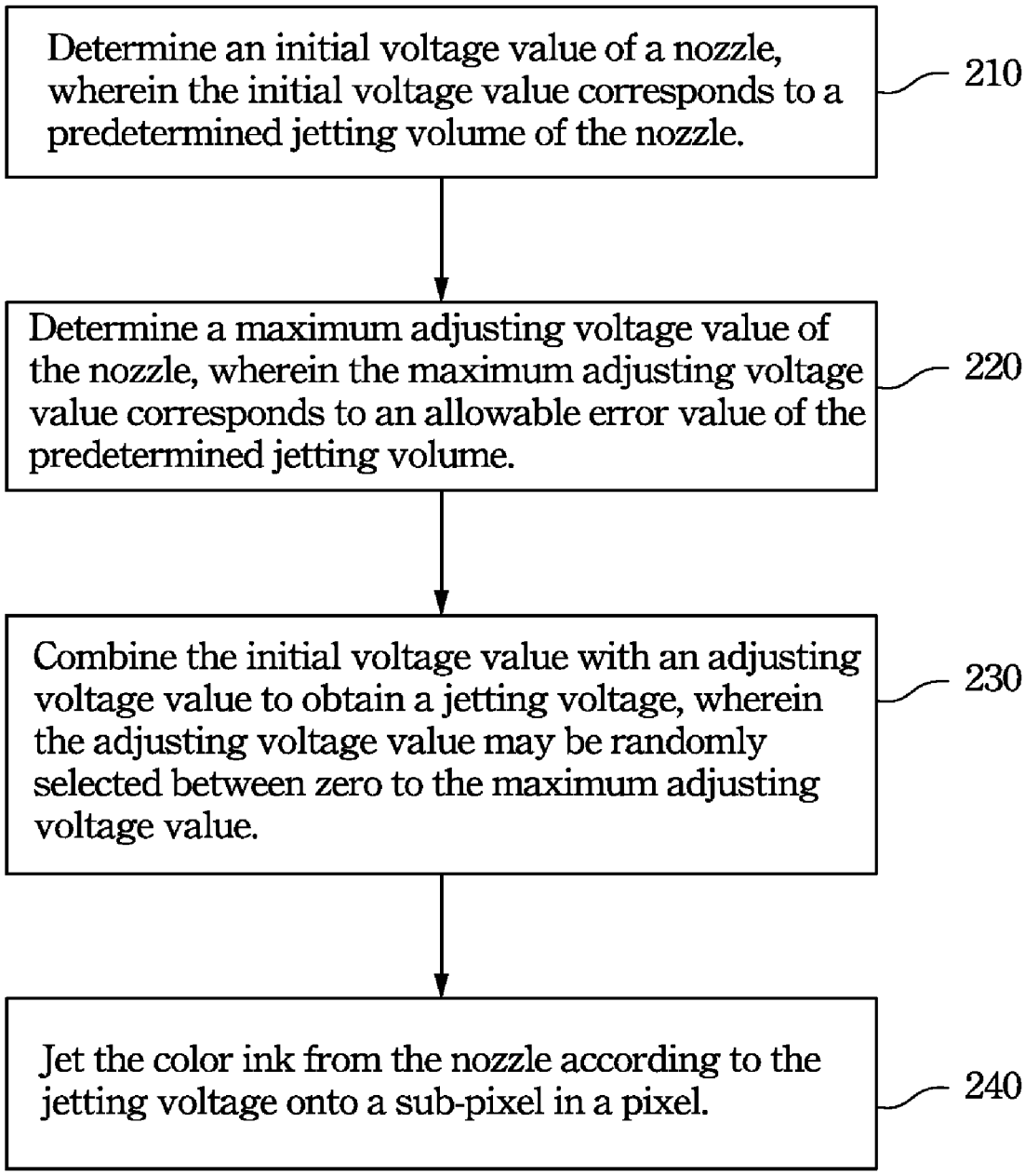
FIG. 2 is a flowchart of diagram of an embodiment of a method for jetting color ink of the invention.

Refer to FIG. 2 illustrating a flowchart of a preferred embodiment of the present invention of the method for jetting color ink. The method for jetting color ink starts with determining an initial voltage value of a nozzle of step 210, wherein the initial voltage value corresponds to a predetermined jetting volume of the nozzle. Step 220 is determining a maximum adjusting voltage value of the nozzle, wherein the maximum adjusting voltage value corresponds to an allowable error value of the predetermined jetting volume.

Then, step 230 is combining the initial voltage value with an adjusting voltage value to obtain a jetting voltage. The adjusting voltage value may be randomly selected from zero to the maximum adjusting voltage value. In step 240, the nozzle may jet color ink onto a sub-pixel in a pixel according to the jetting voltage obtained in step 230.

Figure 3:
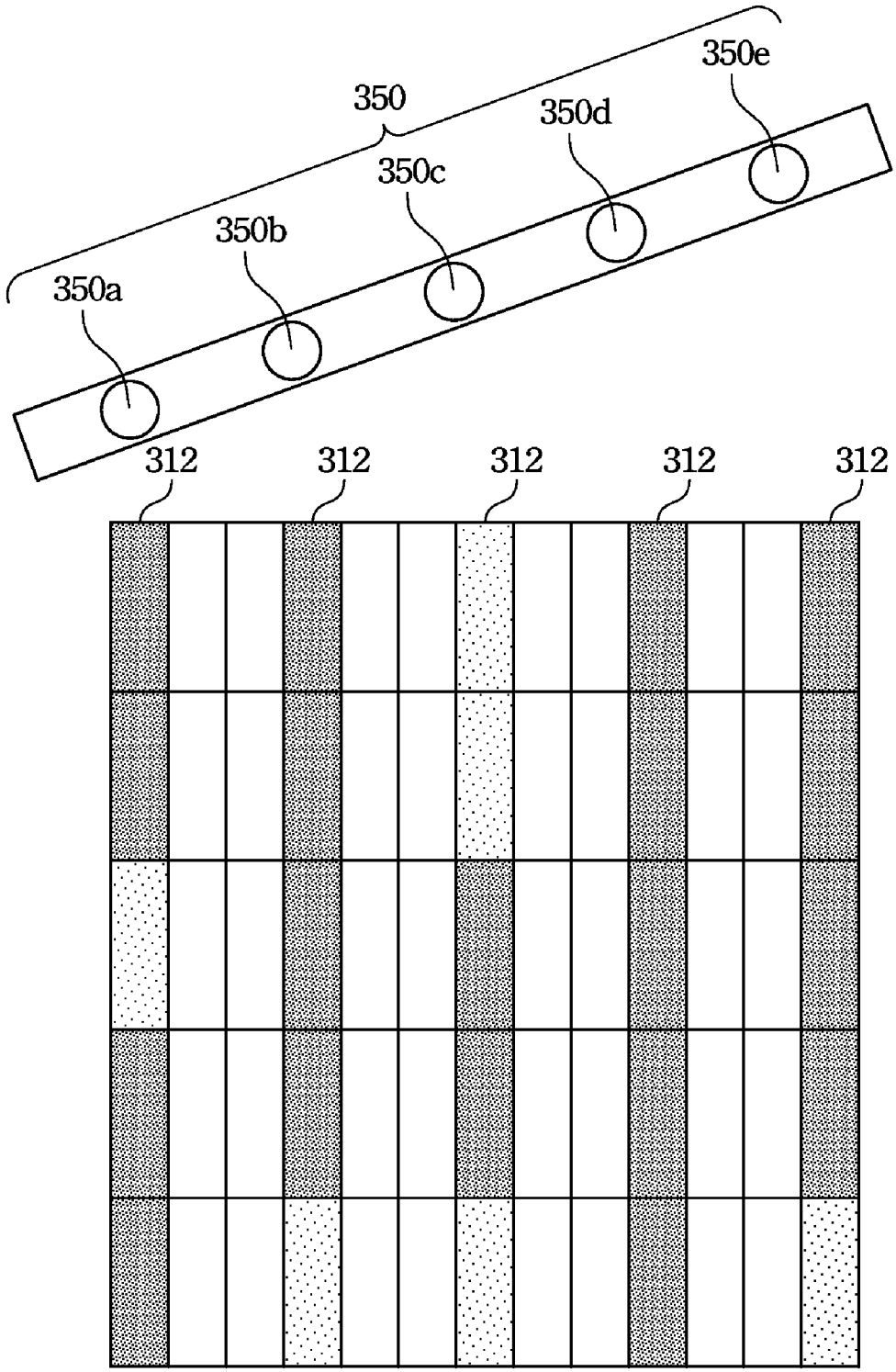
FIG. 3 is a schematic diagram of the embodiment of the method for jetting color ink in FIG. 2 applied to a color filter of the invention.

Refer also to FIG. 3 illustrating a schematic diagram of an embodiment of the method for jetting color ink in FIG. 2 applied to a color filter of the invention. Due to using the method for jetting color ink illustrated in the embodiment, step 230 to step 240 may be repeated to determine the jetting voltage for each nozzle 350 when each nozzle 350 jets color ink, thereby allowing the nozzles 350 to jet color ink with different jetting voltages.

In the case of sub-pixels 312, when the color ink is jetted to fill the different sub-pixels 312, the nozzles 350 can randomly select different jetting voltages to jet droplets of different sizes. As such, the differences in droplet size jetted by each nozzle can also be randomly spread out, and the differences are not concentrated on a particular nozzle 350.

In step 210, when designing the logic for randomly selecting an adjusting voltage value, the initial voltage value of each nozzle 350 is preferably not completely the same, and the initial voltage value controls the predetermined jetting volume corresponding to a nozzle. The differences between the predetermined jetting volumes of the nozzles 350 are preferably controlled within plus or minus 2%. For example, the initial jetting voltage value of the nozzle 350*a* may correspond 1.010 times the predetermined jetting volume, the initial jetting voltage value of the nozzle 350*b* may correspond 1.005 times the predetermined jetting volume, the initial jetting voltage value of the nozzle 350*c* may correspond 1.000 times the predetermined jetting volume, the initial jetting voltage value of the nozzle 350*d* may correspond 0.995 times the predetermined jetting volume, and the initial jetting voltage value of the nozzle 350*e* may correspond 0.990 times the predetermined jetting volume. As such, the regular changes between each nozzle 350 may be offset to further spread out the differences in droplet size.

For example, the allowable error value corresponding to the maximum adjusting voltage value may be plus or minus 2% of the predetermined jetting volume of step 210, and a range of plus 2% to minus 2% of the predetermined jetting volume may be partitioned into 11 to 21 levels. The adjusting voltage value may be randomly selected one from the multiple levels.

Next, step 230 combines the initial voltage value of each nozzle 350 of step 210 with the adjusting voltage value obtained in step 220 to obtain the jetting voltage of each nozzle 350. At this point, the jetting voltage for each nozzle 350 can be differentiated by choosing different adjusting voltage values, thereby allowing the size of the color ink droplets jetted from each nozzle 350 to randomly change.

Figure 4:
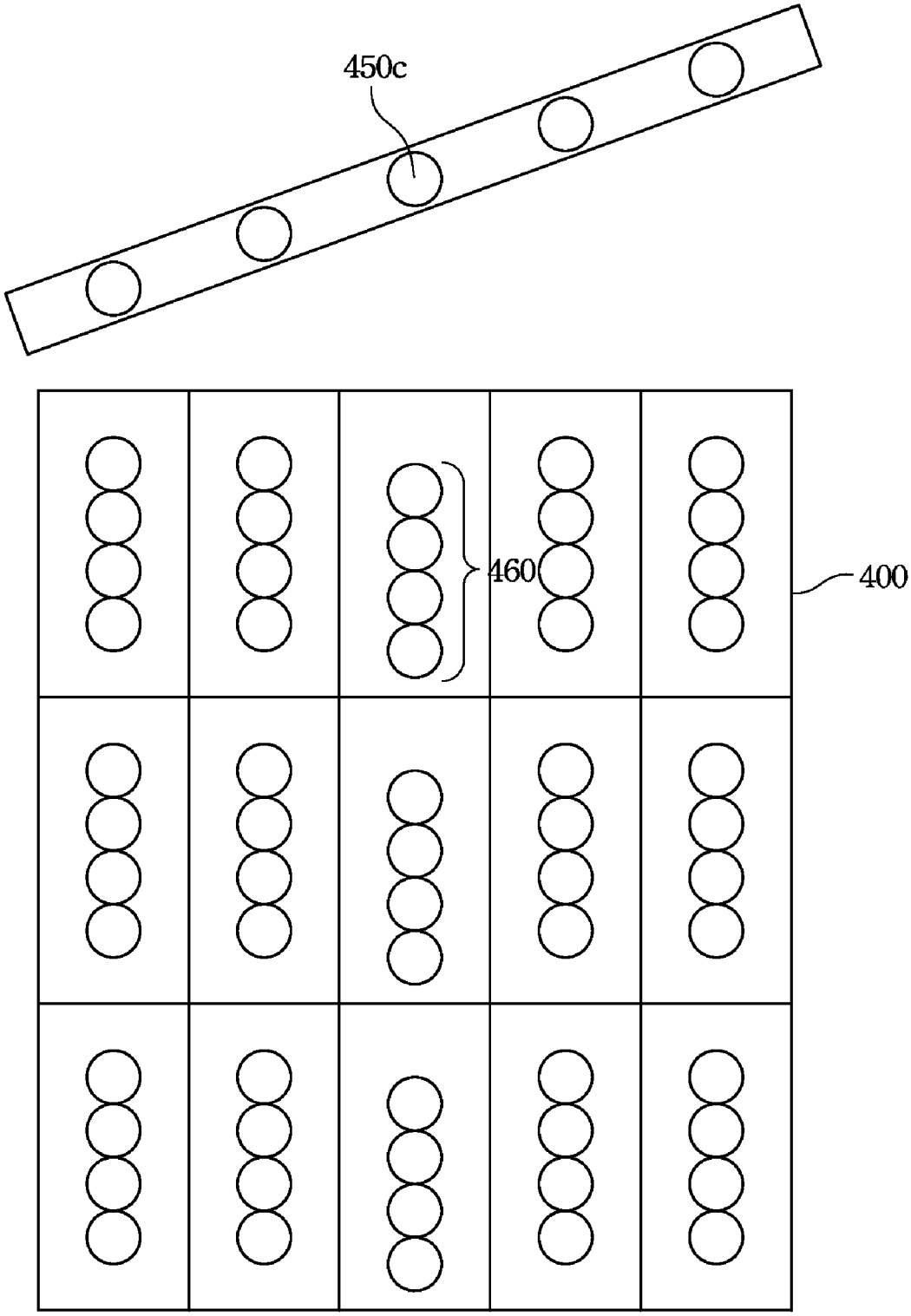
FIG. 4 is a schematic diagram of another embodiment of a defective color filter of the prior art.

Landing points of the droplets jetted by color ink nozzles in the conventional art mostly remain constant. In addition to difficulties in operation to have all droplet landing points of nozzles remain on the same predetermined positions on a color filter, the differences between each nozzle become more apparent as the time of use increases. Refer to FIG. 4 illustrating a schematic view of another embodiment of the present invention of a defective color filter. In the embodiment, the drop placement of the droplets of the nozzle 450*c* is offset from the other neighboring drop placements of the droplets on the sub-pixels. Therefore, significant nulls appear in the column of the string of color ink droplets 460, and allow a constant defect to appear on an entire color filter, thereby affecting the quality of the color filter 400.

Figure 5:
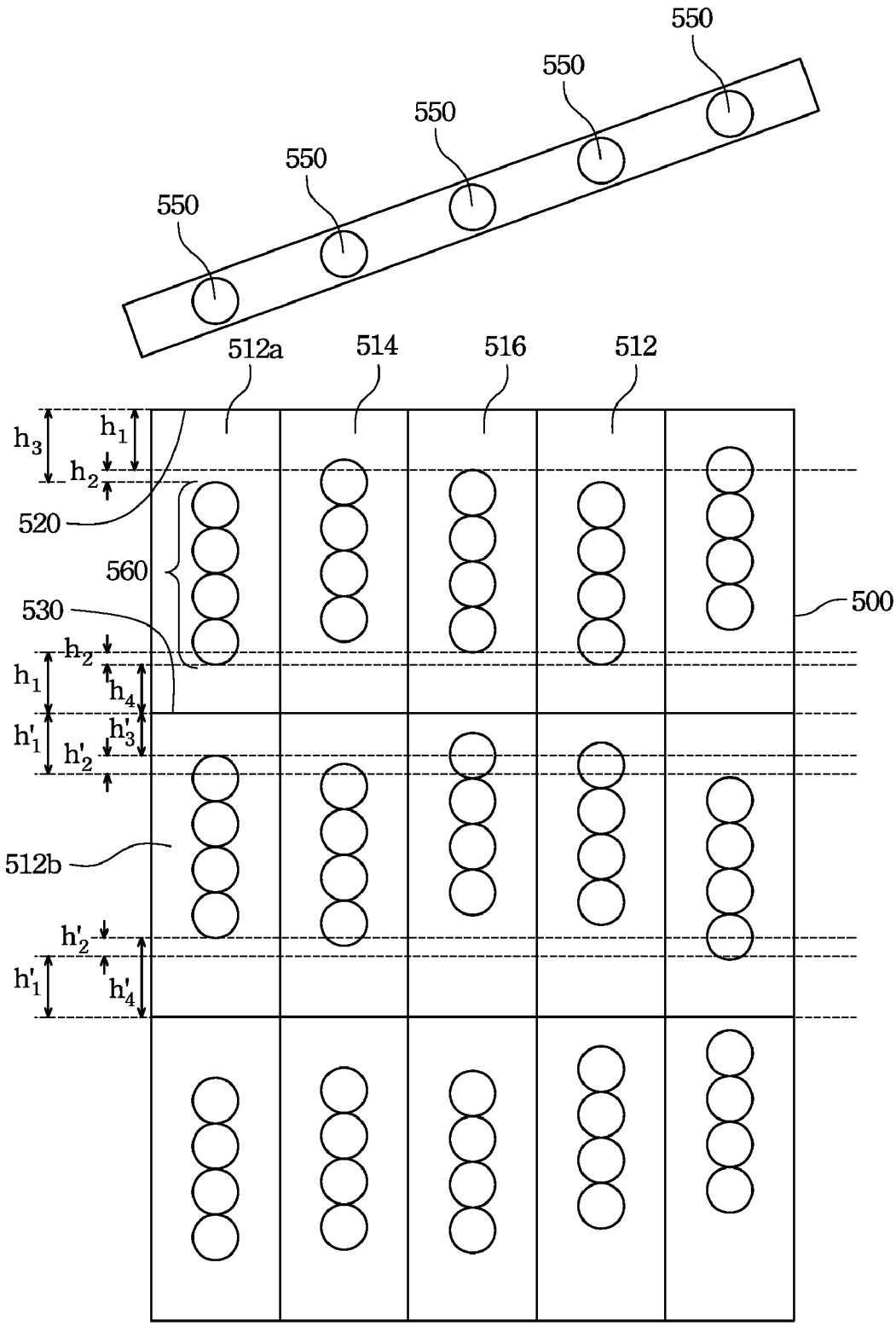
FIG. 5 is a schematic diagram of another embodiment of a method for jetting color ink applied to a color filter of the invention.
Figure 6:
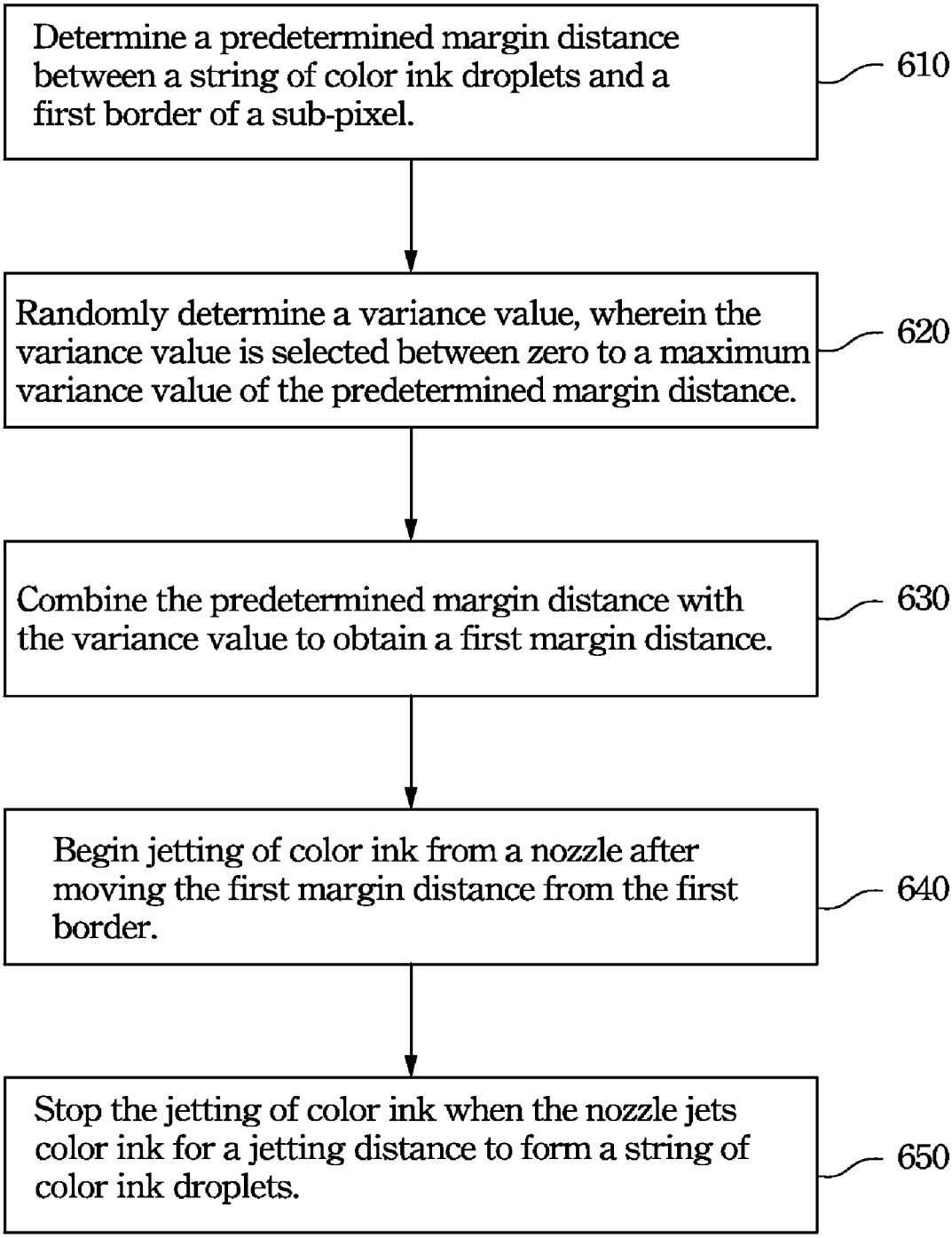
FIG. 6 is a flowchart diagram of another embodiment of a method for jetting color ink of the invention.

Refer to FIG. 5 and FIG. 6 simultaneously. FIG. 5 illustrates a schematic diagram of another embodiment of the method for jetting color ink applied to a color filter of the invention. FIG. 6 illustrates a flowchart diagram of another embodiment of the method for jetting color ink invention. The color filter 500 includes multiple sub-pixels 512, 514, 516, and each column of sub-pixels 512, 514, 516 corresponds to a nozzle 550. Each sub-pixel 512, 514, 516 is respectively defined by a first border 520 and a second border 530, and each sub-pixel 512, 514, 516 is filled with the string of color ink droplets 560 formed by a plurality of color ink dots. The first border 520 and the second border 530 may be defined by a matrix made of, for example, patterned organic materials, patterned inorganic materials, or a patterned metal layer.

In the case of the sub-pixel 512, the method for jetting color ink starts at step 610. Step 610 is determining a predetermined margin distance h1 between the string of color ink droplets 560 and the first border 520 of the sub-pixel 512. Next, step 620 is randomly determining a variance value h2, for example, the variance value h2 is selected between zero to a maximum variance value of the predetermined margin distance. Then, step 630 is combining the predetermined margin distance h1 with the variance value h2 to obtain a first margin distance h3.

Step 640 is the actual dispensing of ink, where the nozzles 550 move the first margin distance h3 from the first border 520, and then begin jetting color ink. Namely, the nozzles 550 begin jetting the color ink after moving the first margin distance from the first border 520. In step 650, the nozzles 550 stop jetting the color ink after a jetting distance to form the string of color ink droplets 560. A distance between the string of color ink droplets 560 and the second border 530 of the sub-pixel 512 is the second margin distance h4. The color ink may include color resists.

The sum of the first margin distance $h_3$ and the second margin distance $h_4$ is twice the predetermined margin distance $h_1$. Therefore, the first margin distance $h_3$ and the second margin distance $h_4$ are both designed complementarily. The sum of both the first margin distance $h_3$ and the second margin distance $h_4$ are the same as the sum of the two original predetermined margin distance $h_1$. For example, the first margin distance $h_3$ in the sub-pixel 512*a* may be the predetermined margin distance $h_1$ plus the variance value $h_2$, and the second margin distance $h_4$ may be the predetermined margin distance h1 minus the variance value $h_2$. Furthermore in another sub-pixel 512*b*, the first margin distance $h_3'$ may be the predetermined margin distance $h_1'$ minus the variance value $h_2'$, and the second margin distance $h_4'$ may be the predetermined margin distance $h_1'$ plus the variance value $h_2'$.

The method for jetting color ink of the embodiment of the invention can randomly change the drop placement of each string of color ink droplets 560, and offset regular changes of each nozzle 550 through an appropriate design of logic in order to spread out the differences of drop placement of the string of color ink droplets 560 as well as correct errors of drop placement of a single nozzle 550 that make white dots concentrated in a particular column more apparent.

For example in step 610, the predetermined margin distance h1 between the string of color ink droplets 560 and the first border 520 of the sub-pixel 512 may be 50 μm. Step 620 may include determining a maximum variance value, wherein the maximum variance value is corresponding to the allowable error value of the predetermined margin distance $h_1$, for example, the allowable error value can be one fifth of a predetermined margin distance, i.e. 10 μm. Next, step 620 may further include partitioning a range of 10 μm to −10 μm into 11 to 21 levels, and the variance value $h_2$ may be randomly selected one from the multiple levels. Then, step 630 is combining the predetermined margin distance $h_1$ with the randomly selected variance value $h_2$ to obtain a first margin distance $h_3$.

Alternatively, the distances between the string of color ink droplets 560 and the borders of the sub-pixels may be controlled by the time of jetting color ink, i.e. controlling the speed of movement of the nozzles 550 and the time of jetting. When designing, for example, ±10 μm of the maximum variance value may be first divided by the speed of movement of the nozzles 550 to calculate the time of movement needed to move ±10 μm. Next, the time interval of movements of ±10 μm is partitioned into 11 to 21 levels, and a variance time is randomly selected from one of the levels. Then, the variance time is combined with the original initial time of jetting to obtain a jetting time, thus randomizing the jetting time for jetting the color ink, thereby changing the distances between the string of color ink droplets 560 and the border of the sub-pixels.

Furthermore, the values of differences in times selected by the nozzles 550 in each neighboring sub-pixel may not be the same. Therefore, not only does the drop placement of the string of color ink droplets 560 vertically (the printing direction) have a differentiated effect, but the differentiated effect can also be seen horizontally in the drop placement of the string of color ink droplets 560.

As can be understood in the aforementioned preferred embodiments of the present invention, the applications of the present invention have the following advantages. The method for jetting color ink of the present invention can spread out the differences in the droplet sizes of color ink and the droplet placement by randomly adjusting the jetting voltage of nozzles, or by randomly adjusting the drop distances of a string of color ink droplets, thereby solving the problem of defects in color filters caused by differences in a particular nozzle.

As is understood by a person skilled in the art, the foregoing preferred embodiments of the present invention are illustrated of the present invention rather than limiting of the present invention. It is intended to cover various modifications and similar arrangements included within the spirit and scope of the appended claims. Therefore, the scope of this invention should be accorded the broadest interpretation so as to encompass all such modifications and similar structure.

What is claimed is:

1. A method for jetting color ink applied to a sub-pixel, comprising:

determining a predetermined margin distance between a string of color ink droplets and a first border of the sub-pixel;

determining a maximum variance value of the predetermined margin distance;

randomly determining a variance value, wherein the variance value is selected between zero to the maximum variance value of the predetermined margin distance;

combining the predetermined margin distance with the variance value to obtain a first margin distance; and beginning jetting of color ink from a nozzle after moving the first margin distance from the first border, wherein the nozzle stops jetting the color ink after jetting the color ink for a jetting distance to form the string of color ink droplets, and a distance between the string of color ink droplets and a second border of the sub-pixel is second margin distance, wherein the first margin distance is the predetermined margin distance plus the variance value, and the second margin distance is the predetermined margin distance minus the variance value, wherein the maximum variance value is one fifth of the predetermined margin distance, wherein the method further comprises partitioning the maximum variance value into a plurality of levels, and randomly selecting the variance value from one of the levels.

2. The method of claim 1, wherein the first margin distance and the second margin distance have a sum of twice the predetermined margin distance.

3. The method of claim 1, wherein the maximum variance value is partitioned into 11 to 21 levels.

* * * * *